United States Patent [19]

Hauser et al.

[11] 4,140,051

[45] Feb. 20, 1979

[54] APPARATUS FOR SEPARATING LIQUID AND SOLID MATERIALS

[75] Inventors: Hans U. Hauser; Alfred Schmid, both of Niederweningen, Switzerland

[73] Assignee: Bucher-Guyer AG Maschinenfabrik, Niederweningen, Switzerland

[21] Appl. No.: 752,668

[22] Filed: Dec. 20, 1976

[30] Foreign Application Priority Data

Dec. 22, 1975 [CH] Switzerland ..... 16635/75

[51] Int. Cl.[2] ..... B30B 5/02

[52] U.S. Cl. ..... 100/116; 99/495; 100/211

[58] Field of Search ..... 99/456, 495, 458–459; 100/110, 122, 131, 211, 116; 210/350, 498–499

[56] References Cited

U.S. PATENT DOCUMENTS

| | | | |
|---|---|---|---|
| 1,916,393 | 7/1933 | Smith | 210/498 |
| 3,808,966 | 5/1974 | Busch | 100/110 |
| 3,969,995 | 7/1976 | Krueger | 100/110 |
| 4,024,810 | 5/1977 | Braun | 100/211 |

FOREIGN PATENT DOCUMENTS

| | | | |
|---|---|---|---|
| 1001589 | 1/1957 | Fed. Rep. of Germany | 100/211 |

*Primary Examiner*—Christopher K. Moore
*Attorney, Agent, or Firm*—Werner W. Kleeman

[57] ABSTRACT

An apparatus for separating liquid and solid materials, especially for extracting juice from agricultural products, particularly from fruits, comprising a rotatably mounted press container subdivided by a substantially hood-like press or squeezing diaphragm into a pressure compartment and a press or squeezing compartment. The pressure compartment has an inlet arrangement for a pressurized fluid medium and the squeezing compartment has a juice outlet arrangement. The juice outlet arrangement possesses drainage channels at the solid-wall, preferably dome-shaped section of the container located opposite the squeezing diaphragm. The drainage channels are formed by substantially trough-shaped elements provided with perforations and arranged in spaced relationship from one another at the inside of the wall of the container.

11 Claims, 16 Drawing Figures

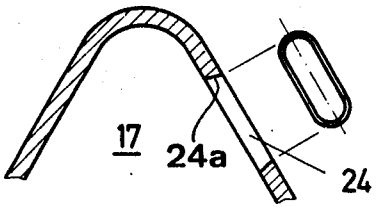
Fig.7
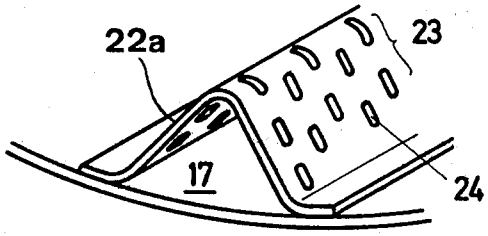
Fig.6
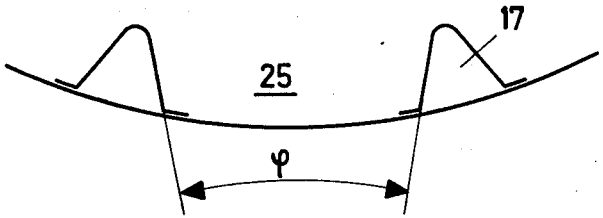
Fig.11
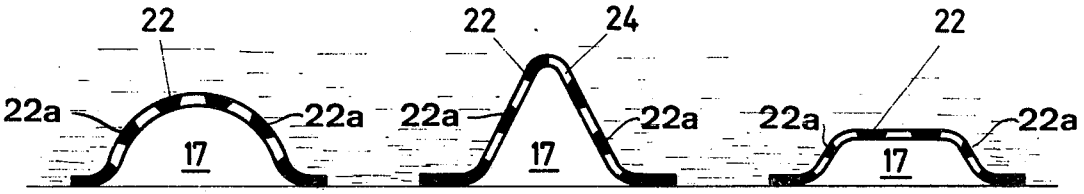
Fig.10
Fig.9
Fig.8
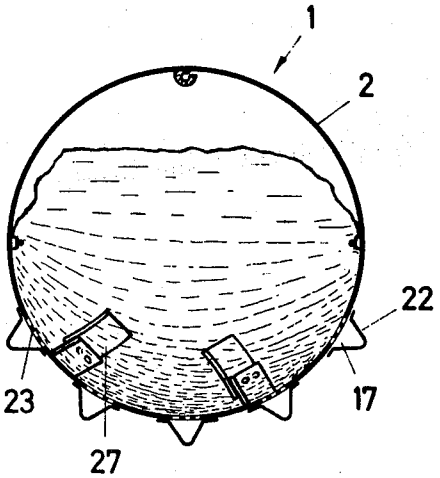
Fig.12

APPARATUS FOR SEPARATING LIQUID AND SOLID MATERIALS

BACKGROUND OF THE INVENTION

The present invention relates to a new and improved construction of apparatus for separating liquid and solid materials from one another, especially for removing juice from agricultural products, in particular from fruit, which apparatus is of the type comprising a rotatably mounted press container subdivided by a substantially hood-shaped press or squeezing diaphragm into a pressure compartment and a squeezing compartment, wherein the pressure compartment possesses an inlet arrangement for a pressurized fluid medium and the squeezing compartment a juice outlet arrangement.

With conventional piston presses the press container can be provided at its entire outer surface and, of course, also at its one end face with perforations, and the container wall is extensively part of the juice outlet arrangement. The same is also the case for an apparatus which has become known to the art from German Pat. No. 1,001,589, for squeezing fruit or the like, wherein a hose-shaped press bag, replacing the press piston, and extending along the axis of the container, is surrounded by a filter jacket or shell, in other words, an outer surface or jacket which without limitation is pervious to the juice and in its entirety forms part of the juice outlet arrangement.

With an apparatus of the previously mentioned type, such as disclosed, for instance, in U.S. Pat. No. 2,538,403, the part of the container wall which is covered by the hood-shaped press or squeezing diaphragm is completely lost for use as the juice outlet arrangement. As an obvious compensation for such loss is to increase the density of the perforations at the container wall bounding the squeezing or press compartment and/or to increase the pressing or squeezing pressure.

SUMMARY OF THE INVENTION

It is a primary object of the present invention to provide a new and improved construction of apparatus for separating liquids from solid materials which is not associated with the aforementioned drawbacks and limitations of the prior art proposals.

Another and more specific object of the present invention aims at the provision of an apparatus of the previously mentioned type which, without increasing the perforation density and/or the squeezing pressure, not only compensates the aforementioned loss, in fact over compensates such and thus generally increases the yield in juice.

Now in order to implement these and still further objects of the invention, which will become more readily apparent as the description proceeds, the apparatus of the present invention is manifested by the features that the juice outlet arrangement is provided with drainage channels at the solid-wall, preferably dome-shaped section of the container located opposite the press or squeezing diaphragm. These drainage channels are formed by substantially chute- or trough-shaped elemments provided with perforations arranged in spaced relationship from one another at the inside of the container wall.

With this arrangement the perforation density is not increased, rather decreased, since the container basically is of solid-wall construction, and thus, there are no perforations between the trough-shaped elements. Surprisingly, the yield in juice is nonetheless increased. This is particularly so because the pressed or squeezed material in this case is not only pressed against a perforated wall, but rather, more significantly, against solid-wall surfaces which by virtue of their "complete" resistance, for a certain squeezing pressure, bring about a much more extensive squeezing action than the webs of a perforated wall located between the throughpassage openings. In addition thereto, the squeezed or pressed material is creviced or fissured by the trough elements, producing a type of toothing in that the trough elements dig into the squeezed material and the latter has formed thereat rib-shaped or web-shaped "projections" penetrating between the drainage elements. Due to these projections, the juice however can flow-off laterally into the drainage channels. Consequently, the juice is also collected and removed at those locations where there are no perforations at all. In reality, the pressed or squeezed material thus forms drainage inserts, at those locations where it penetrates between the trough elements, and which deliver to the drainage channels the juice squeezed out by means of the solid walls and thus available in increased quantities. Stated once again: because of the reduction in the perforation density, i.e. due to the provision of perforation-free wall sections, the yield in juice is increased, wherein, however, the juice can also flow-off at the perforation-free regions, namely towards the sides into the trough elements.

According to a preferred embodiment, successively neighboring chute or trough elements form with one another inwardly widening, i.e. outwardly narrowing channel- or groove-like intermediate spaces. Consequently, upon penetration of the squeezed material into these intermediate spaces there is produced a compaction, i.e. a secondary squeezing action. Thus, while on the one hand the squeezed material itself assumes the role of drainage inserts, the actual drainage elements, that is to say, the chute or trough elements actively participate in the squeezing or pressing operation.

Advantageously, the perforations of the chute or trough elements which is cross-section are rounded, roof-shaped or arc-shaped, possess elongate holes extending transversely with respect to the lengthwise extent of the trough elements. Therefore, as will be explained more fully hereinafter, there is considerably reduced the danger of clogging, especially if the elongate holes have an inner width which widens in the direction of the drainage channel.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 6 is an end sectional view of a drainage channel of the juice outlet arrangement;

FIG. 7 is a fragmentary cross-sectional view, on an enlarged scale, through the roof-shaped boundary walls of the drainage channel shown in FIG. 6;

FIGS. 8, 9 and 10 illustrate different cross-sectional shapes of elements useful for forming the drainage channels;

FIG. 11 is a fragmentary cross-sectional view of a container showing the mutual arrangement of the drainage channels;

FIG. 12 is a cross-sectional view, corresponding to the showing of FIGS. 2 to 4, of a modified juice outlet arrangement;

DETAILED DESCRIPTION OF THE PREFERRED EMBODIMENT

Figure 1:
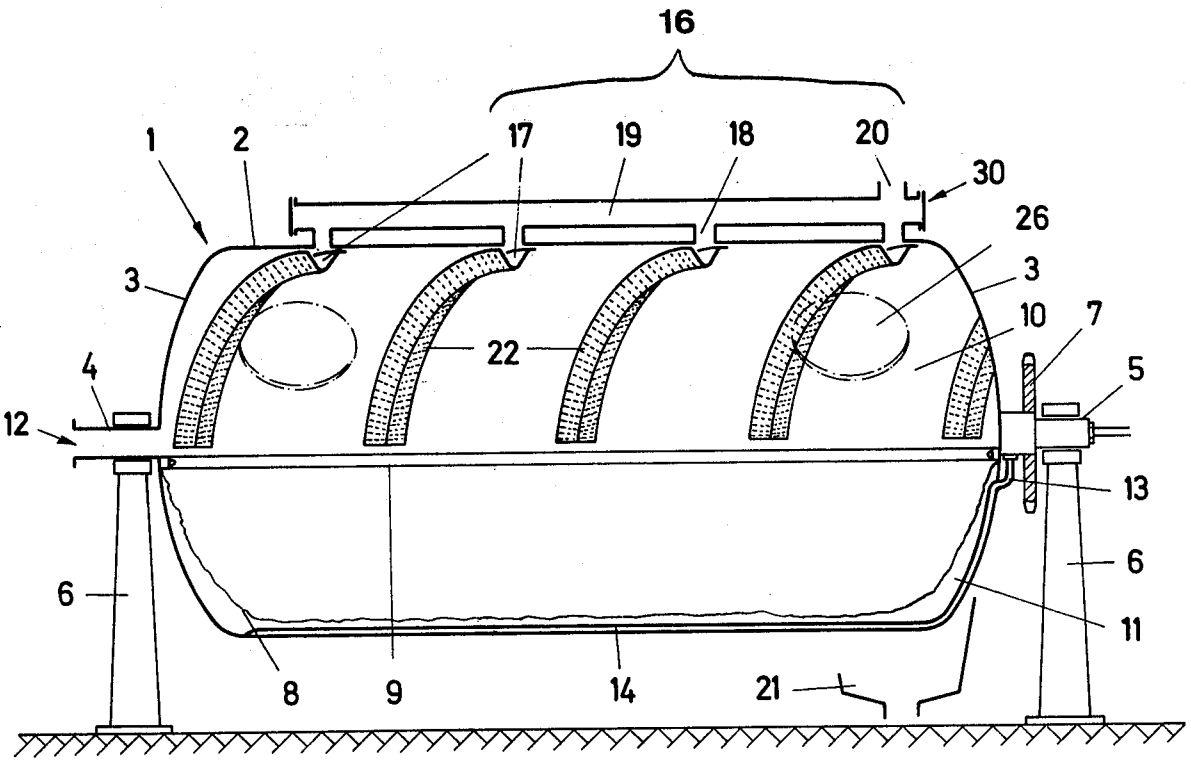
FIG. 1 is an axial sectional view of an apparatus for extracting juice from agricultural products and containing a substantially cylindrical press container.

Describing now the drawings, according to the exemplary embodiment of apparatus shown in FIG. 1, the press container 1 will be seen to comprise a substantially cylindrical shell or jacket 2 closed at both ends by domed or arched end walls 3. These domed end walls 3 are equipped with hollow journals or trunnions 4 and 5 which, in turn, are rotatably mounted in the bearing or pillow blocks 6. A gear 7 rigidly connected for rotation with the journal 5, represents the rotatable drive or drive means for the press container 1.

Within the press container 1 there is located a substantially hood-shaped press or squeezing diaphragm 8, the edge of which is sealingly anchored in appropriate fashion at the immediate region of an axial plane of the container 1 at the walls thereof, i.e. at the jacket 2 and both of the end walls 3. This anchoring structure which extends completely around the press container 1 has been generally indicated by reference character 9. By virtue of this arrangement, the press container 1 is subdivided by means of the diaphragm 8 into a press or squeezing compartment 10 and a pressure compartment 11. This pressure compartment 11 communicates in a controlled or controllable manner by means of an inlet arrangement, generally indicated by reference character 12, — and which will be more fully described hereinafter — with a not particularly illustrated source for a pressurized fluid medium. The expression "pressure" as here employed signifies both excess pressure as well as negative pressure, and it is thus contemplated to introduce the pressurized fluid medium into the pressure compartment 11 and to withdraw it from such pressure compartment. In one instance, the size of the pressure compartment 11 is increased at the expense of the press or squeezing compartment 10, and, in the other case, the diaphragm 8 is more or less placed against the inner wall of the container. The hollow journal 5 serves as part of the inlet arrangement 12 and is connected by means of a by-pass arrangement or line 13 with at least one inlet line or conduit 14 bearing at the inside of the container wall. A possible construction of the inlet conduit or line 14 has been shown in FIG. 5, and on a smaller scale also in FIGS. 2 to 4. It will be seen that the inlet conduit 14 possesses directly at the region of the container jacket or shell 2 recesses 15 (e.g. holes and/or slots), by means of which the fluid medium can move out of the conduit 14 into the pressure compartment 11. The illustrated arrangement of the recesses 15 — as will be particularly well recognized from the showing of FIG. 2 — importantly provided in order to prevent such recesses from being covered by the diaphragm 8 and thus being closed. FIG. 1 shows that the inlet conduit 14 extends to the region of the end walls 3 in order to distribute the fluid medium as uniformly as possible behind the diaphragm 8. For this purpose the outlet cross-section can gradually increase, starting from the beginning of the inlet conduit 14.

According to the showing of FIG. 1, the juice outlet arrangement comprises a number of drainage channels 17 which are connected by means of radial studs or connections 18 with a collecting pipe or conduit 19 arranged externally of the container 1. This collecting pipe or conduit 19 possesses an outlet stud or connection 20 which, during rotation of the container 1, comes to lie above a collecting trough or channel 21.

According to the showing of FIG. 1, the drainage channels 17 are formed by trough or chute elements 22 or equivalent structure which are of substantially roof-shape configuration in cross-section (cf. also for instance FIG. 9) and which extend in the manner of convolution or winding sections of an imaginary screw line and bear at the jacket 2 of the container 1. The trough or chute elements 22 are provided with perforations (cf. also FIG. 6) generally designated in their entirety by reference character 23. These perforations 23 comprise a multiplicity of elongate or longitudinally extending holes 24, i.e. holes which extend in elongated fashion in the direction of sliding movement of the mash or other material which is squeezed. As particularly apparent from FIG. 7, the inner width 24*a* of the elongate holes 24 increases in the direction of the drainage channels 17. The significance of these elongate holes 24 will be explained more fully hereinafter.

What is important with regard to the construction of the drainage channels 17 which — as will be recognized from FIG. 6 or FIGS. 2 to 4 — also can extend along the surface lines or generatrices, is the following: the channel- or groove-shaped intermediate space 25 between neighboring trough elements 22 — to the extent that the latter are located within the container — advantageously posses a cross-section which widens in the direction of the interior of the press container 1. This can be realized for instance if the trough or chute elements 22 are constructed such that in cross-section they possess, for instance, an arc-shaped, rounded or flattened roof configuration (FIGS. 8 to 10). Stated in another way: the flanks of neighboring trough elements — as shown in FIG. 11 — mutually enclose an angle $\gamma$.

The significance of these measures will be recognized in conjunction with the explanations of the mode of operation of such apparatus. In order to better understand these explanations, it is here only necessary to remark that at the segment or section of the container wall 1*a* opposite the diaphragm 8, i.e. jacket 2, but also at the end walls 3, there is provided a multiplicity of drainage channels 17, and at least one closable infeed- and emptying opening 26 (according to the showing of FIG. 1 two such openings are provided) is provided at the container jacket 2 neighboring the anchoring means 9 for the diaphragm 8. In the case of an elongate or lengthwise extending container, it is furthermore advantageous to provide the infeed- or emptying opening at the region of one end of the press container 1, and at the jacket or shell 2 there can be arranged approximately screw- or helical-shaped outfeed elements, so that during rotation of the container 1 the product residues can be successively delivered to the emptying opening. With the embodiment of FIG. 1, this function is assumed by the trough elements 22. With the embodiment of FIG. 12 there are provided rib- or web-like outfeed elements, as generally indicated by reference character 27. These elements 27, equally the trough elements 22 in the case of the embodiment of FIG. 1, basically form a type of discharge or outfeed worm. It is also possible to use the hollow journal 4 for infeeding the product mash or the like.

Figure 13:
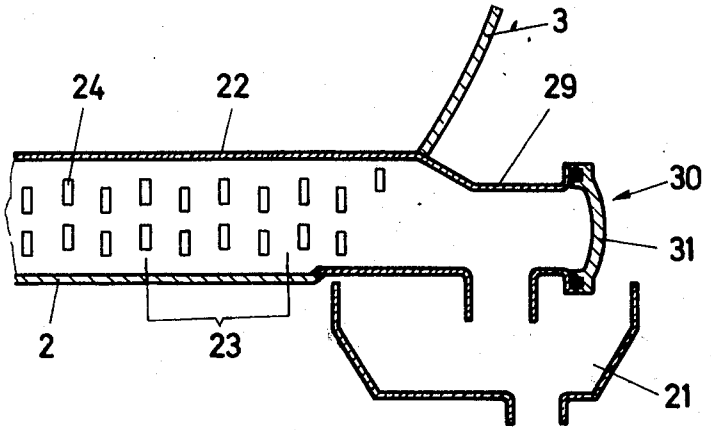
FIGS. 13, 14 and 15 show in respective sectional views different possible embodiments of juice outlet arrangements at the region of the juice outlet from the container.
Figure 14:
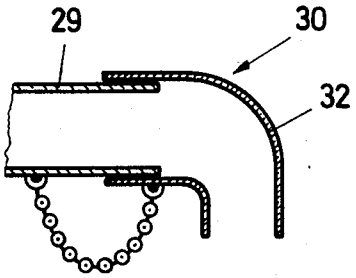
Figure 15:
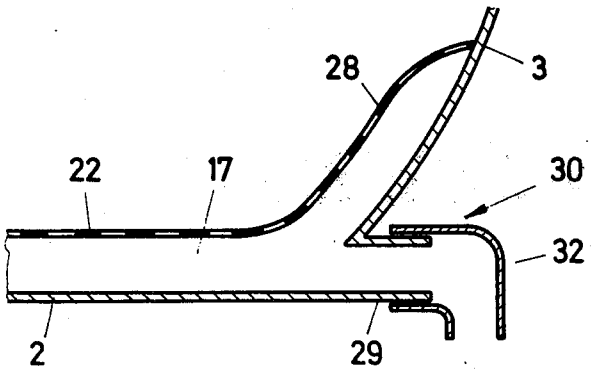

FIGS. 13, 14 and 15 illustrate details of different embodiments of juice outlet arrangements. In all instances here under discussion, there are provided trough or chute elements 22 or equivalent structure which in cross-section can be constructed to correspond to the arrangements shown in FIGS. 8 to 10. Also here the perforations 23 of the trough elements 22 comprise elongate holes 24. According to the showing of FIG. 15 the trough elements extend by means of a curved portion or bend 28 to the region of the end walls 3, in order to correspondingly increase the length of the drainage channels 17. The drainage channels 17 in each case open into a drainage stud or connection 29 mounted at the one end wall 3, and which drainage stud is provided at its end with a quick-release closure 30. According to FIG. 13 the quick-release closure 30 is formed by a cover 31, according to FIGS. 14 and 15 by a curved or bent tube 32 with the cover member 31 and bent tube 32 attached to be easily removable at the stud or connection 29. Due to these measures the drainage channels 17 can be easily cleaned from the outside. The arrangement is of course carried out such that the juice arrives at the catch or collecting trough 21 when the drainage channels 22, as a function of the rotational position of the container 1 or the liquid level, are located within and below the liquid level. The catch or collecting trough 21 is constructed to be approximately arc-shaped or curved. This makes it possible, also with the embodiment of FIG. 1, to provide more than one collecting pipe or conduit 19. For cleaning purposes such collecting pipes are also advantageously equipped with a quick-release closure 30.

Figure 16:
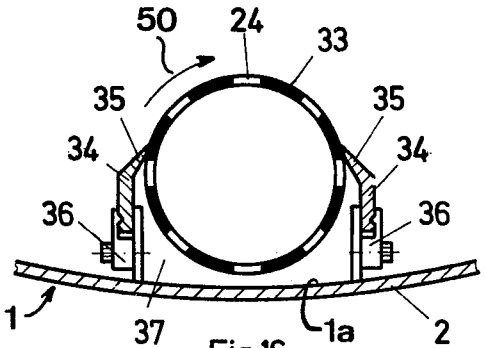
FIG. 16 is a cross-sectional view of a substantially tubular-drainage channel and its arrangement in the container.

FIG. 16 illustrates in cross-sectional view a perforated pipe or conduit 33 which is arranged next to and at the inside or inner surface of the jacket 2 i.e. the container wall 1*a*, extends along a surface line or generatrix and by means of its section or segment confronting the diaphragm forms a trough element. The pipe or conduit 33 extends through the one end wall 3 and is constructed at its outer end such that it allows the juice to flow off into the catch or collecting trough 21. Hence, the pipe or conduit 33 forms a drainage channel 17. Now, in not particularly illustrated manner, the pipe or conduit 33 can be mounted in the press container 1 to be rotatable about its own axis or displaceable lengthwise thereof. With the construction according to FIG. 16, the pipe or conduit 33 is rotatably mounted, as generally indicated by the arrow 50. It is located between preferably elastic stripper ledges or blades 34, each of which bear by means of a substantially lip-shaped lengthwise edge 35 at the outer surface of the pipe or conduit 33. These stripper ledges or blades 34 are anchored in the container 1 by means of the mounting fixtures 36 or the like. The arrangement is carried out such that only the pipe section or segment protruding between the lips or lip members 35 into the press or squeezing compartment comes into contact with the mash, and the latter does not reach the hollow compartment 37 between the conduit 33 and the container jacket or shell 2. Owing to the rotatability of the pipe or conduit 33, here the elongate holes 24 are oriented in the peripheral direction. Consequently, the action of the stripper ledges 34 is enhanced since solid parts, for instance the skins of grapes, cannot be caught in the perforations. The conduit or pipe 33 can be suitably operatively connected with the drive of the container 1 in such a manner that upon rotation of the container also the pipe or conduit 33 experiences a rotational movement.

When using a perforated pipe or conduit 33 there can be employed, instead of the stripper ledges 34, also ring-shaped strippers (not shown). In this instance, the pipe 33 is displaceably mounted in axial direction, and, of course, the axial displacement path and the number i.e. the mutual spacing of the strippers is chosen such that the pipe 33 can be cleaned over its entire length. Also in this case the power for to-and-fro shifting of the pipe 33 is derived from the drive of the container. Owing to the lengthwise displaceability, here the elongate holes 24 should be oriented in axial direction. Both for this embodiment and that of FIG. 16 there are of course provided a number of drainage channels 17 formed by perforated pipes analogous to the constuction according to FIGS. 2 to 4.

Figure 2:
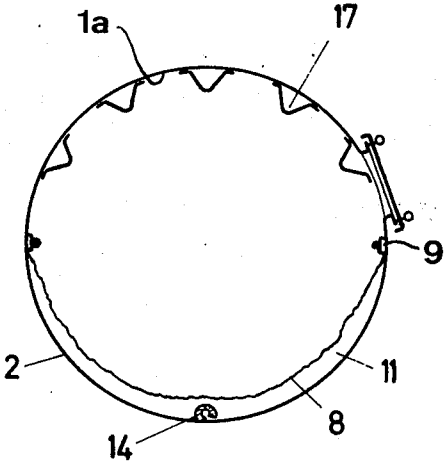

Now in order to place the apparatus into operation, the container 1 is initially rotated into the position shown in FIG. 2, in other words, into a position where the diaphragm 8 depends downwards. Now if the pressure compartment 11 is connected with a negative pressure source, then the diaphragm 8 is applied against the wall of the shell or jacket 2 or at least is stretched in the direction of such jacket. Since the negative pressure is maintained in the compartment 11, the diaphragm 8 also assumes its previously described position even when the container assumes the position according to FIG. 3, where the infeed or filling opening 26 is located at the top. Part of the drainage channels 17 are located at the lower half of the container 1, so that the juice begins to already flow-off during the filling operation, like in a draining container or colander.

Figure 4:
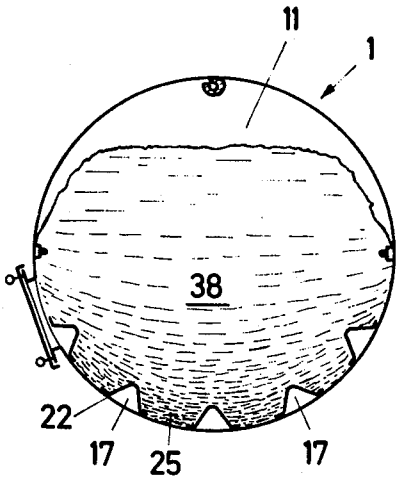
FIGS. 2, 3 and 4 illustrate in cross-sectional view a press container basically corresponding to that shown in FIG. 1, modified somewhat with regard to the juice outlet arrangement, and shown in different work positions.
Figure 5:
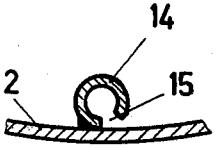
FIG. 5 illustrates on an enlarged scale a detail of the arrangement of FIGS. 2 to 4.

After complete filling of the container 1 the same is brought into its work position shown in FIG. 4, where all of the drainage channels 17 are located at the lower half of the press container 1. Now the negative pressure in the compartment 11 is replaced by an excess pressure and the mash 38 is subjected to the action of the pressurized fluid medium cushion which builds up in the pressure compartment 11. As will be recognized from the showing of FIG. 4, the pressurized fluid medium cushion surrounds the mash in the manner of a dome, so that the mash cake is not simply pressed flat, as would be the case if there were used a piston, rather is extensively compressed. There thus prevails a press or squeezing operation which is soft in more than one way.

In this respect, the shape or cross-section of the elements forming the drainage channels 17 play a certain role, to the extent that such are arranged within the container. During the press or squeezing operation, the mash, or more specifically, the residues slide along the inclined surfaces 22*a* of the trough elements 22 and the surfaces of the pipes 33 in the direction of the container jacket or shell 2, so that there are stripped-off for instance grape skins and there is carried out a type of self-cleaning action at the perforations, this being effectively so due to the fact that the elongate holes 24 make more difficult or even prevent any catching of the skins or the like. During this operational phase, the enlargement of the cross-section of the elongate holes also is advantageous. Since the channel-like intermediate spaces between the trough elements 22 and the pipes 33 widen inwardly in cross-section, there is formed during the product squeezing or pressing operation an additional compression of the mash reaching such intermediate spaces, without the mash forming bridges in such intermediate spaces and becoming caught. Consequently, there is insured that between successive squeezing operations, when the pressure compartment 11 is relieved and the container 1 rotated, there occurs a so-called "place change", so that always new parts of the filled material arrive at the region of the drainage channels. In this way, each charge can have the juice removed therefrom rapidly and in a protective manner.

The withdrawal of the residues occurs during rotation of the container 1 with the aid of the outfeed elements 27 or the trough elements 22. Thus, as a modification of the embodiment of FIG. 1, for this purpose such trough elements can be basically arranged in lengthwise orientation at the container jacket, without exactly following the generatrices or jacket lines. In order to exert a conveying action, they can approximately correspond to the arrangement of a multiple-thread screw of increased pitch. This type of construction is not precluded by the internal cleaning which is accomplished.

Figure 3:
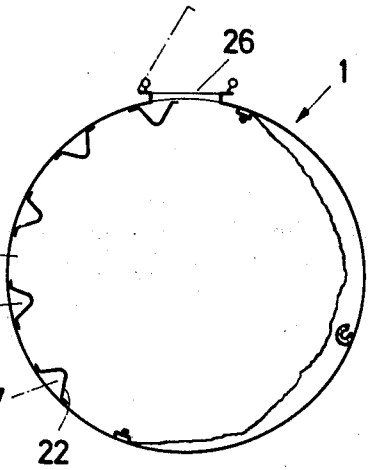

In order to again explain the invention, in this instance, however, from the "reverse side", reference is here made to the press according to the showing of FIG. 12, which differs from the embodiment of FIGS. 2 to 4 in the first instance by virtue of the fact that the drainage channels 17 are here located outside of the container jacket 2. Thus, with this embodiment the (non-perforated) trough elements 22 are mounted at the outside of the jacket or shell 2. In order to communicate the drainage channels 17 with the press compartment, the sections or segments of the jacket 2 bridged by the trough elements 22 are provided with perforations 23.

With this press, there are provided between the drainage channels solid-wall sections, yet the juice which is pressed out at that location cannot flow-off laterally since the perforations (limited in surface) are not capable of outfeeding the entire quantity of juice which is produced. Furthermore, the pressed or squeezed material is indiscriminately pressed against the solid-wall and perforated sections, so that, on the one hand, the perforations are easily clogged, and, on the other hand, at the region of the solid-wall sections, there does not arise or at most only to a limited extent, a drainage action due to the pronounced compaction of the material. The trough elements located within the container or drum 1 are less subject to the aforementioned clogging danger than the flat perforations of the container wall, and additionally, the trough elements prevent, expecially when they possess the illustrated cross-sectional shape, an exclusively or predominantly radial compaction of the pressed or squeezed material and therefore closing or clogging of the drainage capillaries forming there within.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for separating liquid and solid materials from one another, especially for the removal of juice from agricultural products, in particular from fruit, comprising, in combination:

a substantially cylindrical press container having an inner wall;

means rotatably mounting said substantially cylindrical press container;

a substantially hood-shaped squeezing diaphragm subdividing the substantially cylindrical press container into a pressure compartment and a squeezing compartment;

means defining an inlet arrangement for a pressurized fluid medium provided for the pressure compartment;

means defining a juice outlet arrangement for the squeezing compartment;

said juice outlet arrangement comprising drainage channels;

said drainage channels being arranged adjacent a solid wall section of the substantially cylindrical press container situated opposite the squeezing diaphragm;

said drainage channels being formed by substantially trough-shaped elements arranged in spaced relationship from one another at said inner wall of the container and provided with perforations;

mutually neighboring ones of said trough-shaped elements forming respective intermediate spaces which widen in cross-section towards the inside of the substanitially cylindrical press container for augmenting the squeezing action to which the squeezed product is exposed;

said mutually neighboring ones of said trough-shaped elements being configured so as to assist in breaking-up the squeezed product so that there continually occurs a positional change of portions of the product located between the intermediate spaces in order to promote the squeezing action; and said mutually neighboring ones of said trough-shaped elements acting as squeezing elements upon random portions of the squeezed product during rotation of the cylindrical press container and throughout the processing of the product.

2. The apparatus as defined in claim 1, wherein said section of the container is substantially dome-shaped.

3. The apparatus as defined in claim 1, wherein:

each intermediate space has a substantially channel-shaped cross-section.

4. The apparatus as defined in claim 1, wherein:

each intermediate space has a substantially groove-shaped cross-section.

5. The apparatus as defined in claim 1, wherein:

the trough-shaped elements each have a substantially roof-shaped cross-sectional configuration.

6. The apparatus as defined in claim 5 wherein:

the roof-shaped configuration is rounded.

7. The apparatus as defined in claim 6, wherein:

the roof-shaped configuration is flattened.

8. The apparatus as defined in claim 1, wherein:

each of the trough-shaped elements possesses a substantially arc-shaped cross-sectional configuration.

9. An apparatus for separating liquid and solid materials from one another, especially for the removal of juice from agricultural products, in particular from fruit, comprising, in combinaton:

a press container having an inner wall;

means rotatably mounting said press container;

a substantially hood-shaped squeezing diaphragm subdividing the press container into a pressure compartment and a squeezing compartment;

means defining an inlet arrangement for a pressurized fluid medium provided for the pressure compartment;

means defining a juice outlet arrangement for the squeezing compartment;

said juice outlet arrangement comprising drainage channels;

said drainage channels being arranged adjacent a solid wall section of the container situated opposite the squeezing diaphragm;

said drainage channels being formed by substantially trough-shaped elements arranged in spaced relationship from one another at said inner wall of the container and provided with perforations;

mutually neighboring ones of said trough-shaped elements forming respective intermediate spaces which widen in cross-section towards the inside of the press container for augmenting the squeezing action to which the squeezed product is exposed;

the perforations of the trough-shaped elements comprising elongate holes extending transversely with respect to the lengthwise extent of the trough-shaped elements; and each of the elongate holes possessing an inner width widening in the direction of the associated drainage channel;

a collecting pipe;

said trough-shaped elements extending along a screw line for feeding the product lengthwise of the press container and being connected with said collecting pipe.

10. The apparatus as defined in claim 9, further including:

removable quick-release closure means provided for at least one end of the collecting pipe.

11. The apparatus as defined in claim 1, wherein:

said perforations of the trough-shaped elements comprise elongate holes extending transversely with respect to the lengthwise extent of the trough-shaped elements; and each of the elongate holes possessing an inner width widening in the direction of the associated drainage channel.

* * * * *